US005303550A

United States Patent [19]

Setzer

[11] Patent Number: 5,303,550

[45] Date of Patent: Apr. 19, 1994

[54] APPARATUS AND METHOD FOR FORMING ELASTIC CORESPUN YARN

[75] Inventor: Barry D. Setzer, Hickory, N.C.

[73] Assignee: Regal Manufacturing Company, Inc., Hickory, N.C.

[21] Appl. No.: 845,050

[22] Filed: Mar. 3, 1992

Related U.S. Application Data

[63] Continuation of Ser. No. 588,003, Sep. 25, 1990, abandoned.

[51] Int. Cl.[5] ..... D02G 3/38; D02G 3/28

[52] U.S. Cl. ..... 57/58.36; 57/58.38; 57/58.86; 57/352

[58] Field of Search ..... 57/58.36, 58.38, 58.32, 57/58.34, 10, 11, 12, 225, 18, 3, 352, 58.86

[56] References Cited

U.S. PATENT DOCUMENTS

| | | | |
|---|---|---|---|
| 1,964,021 | 6/1934 | Andrew et al. | 57/3 |
| 1,966,585 | 7/1934 | Gibbons | 57/16 |
| 2,010,888 | 8/1935 | Pool | 57/58.32 X |
| 2,458,555 | 1/1949 | Bouvet | 28/187 |
| 2,561,155 | 7/1951 | Thomas, Jr. et al. | 57/116 |
| 2,567,329 | 9/1951 | Frazier | 57/352 |
| 2,571,109 | 10/1951 | Carter et al. | 57/58.86 |
| 2,587,117 | 2/1952 | Clay | 57/15 X |
| 2,624,527 | 1/1953 | Von Kohorn | 242/155 M |
| 2,703,958 | 3/1955 | De Halleux | 57/58.36 |
| 2,737,773 | 3/1956 | Clarkson | 57/3 |
| 2,752,749 | 7/1956 | De Halleux | 57/90 |
| 2,869,313 | 1/1959 | Vibber | 57/58.3 |
| 2,913,867 | 11/1959 | Schrenk | 57/58.3 |
| 3,124,924 | 3/1964 | Smith | 57/18 |
| 3,397,528 | 8/1968 | Zermati | 57/58.36 |
| 3,869,852 | 3/1975 | Hamel | 57/59 |
| 3,902,307 | 9/1975 | Schoerner | 57/13 |
| 3,969,880 | 7/1976 | Maillefer et al. | 57/6 |
| 4,163,357 | 8/1979 | Greive et al. | 57/58.36 |
| 4,204,392 | 5/1980 | Bock | 57/18 |
| 4,299,083 | 11/1981 | Igel et al. | 57/18 |
| 4,309,867 | 1/1982 | Ichikawa | 57/58.3 |
| 4,336,683 | 6/1982 | Bock et al. | 57/18 |
| 4,348,858 | 9/1982 | Rottmayr | 57/18 |
| 4,435,952 | 3/1984 | Stahlecker et al. | 57/18 |
| 4,446,688 | 5/1984 | Ueda | 57/58.65 |
| 4,509,320 | 4/1985 | Maeda | 57/225 |
| 4,606,181 | 8/1986 | Lappage et al. | 57/58.38 |
| 4,689,942 | 9/1987 | Chateau | 57/58.36 |
| 4,709,542 | 12/1987 | Krafft | 57/16 |
| 4,813,219 | 3/1989 | Rees | 57/3 |
| 4,848,075 | 7/1989 | Frentzel-Beyme | 57/264 |

FOREIGN PATENT DOCUMENTS

| | | | |
|---|---|---|---|
| 0310848 | 12/1989 | European Pat. Off. | 57/3 |
| 3023073 | 1/1982 | Fed. Rep. of Germany | 57/3 |
| 1234291 | 5/1959 | France | 57/3 |
| 185415 | 10/1963 | Sweden | 57/58.36 |

*Primary Examiner*—Daniel P. Stodola
*Assistant Examiner*—John Rollins
*Attorney, Agent, or Firm*—Bell, Seltzer, Park & Gibson

[57] ABSTRACT

A spindle is mounted to a frame for rotation about the spindle axis. A core yarn package of elastic core yarn is held stationary on the spindle. Elastic core yarn is withdrawn from the core yarn package in a direction substantially along the spindle longitudinal axis. A nonelastic covering yarn is drawn from a supply package, through the spindle and along a confined yarn guide passageway from the spindle guide passageway outwardly, upwardly and inwardly around and in spaced relation to the core yarn package for confining and guiding the covering yarn, and then into wrapping engagement with the withdrawn core yarn to form a corespun yarn.

6 Claims, 1 Drawing Sheet

APPARATUS AND METHOD FOR FORMING ELASTIC CORESPUN YARN

This application is a continuation of application Ser. No. 07/588,003, filed on Sep. 25, 1990, now abandoned.

FIELD OF THE INVENTION

This invention relates to an apparatus and method for forming an elastic corespun yarn and more particularly to an apparatus and method for forming an elastic corespun yarn wherein a nonelastic covering yarn is drawn into wrapping engagement with the elastic core yarn for forming an elastic corespun yarn.

BACKGROUND OF THE INVENTION

In many types of conventional wrapping apparatus for forming an elastic corespun yarn, and in some two-for-one twisting apparatus, a hollow rotating spindle carries a supply package of nylon or other nonelastic covering yarn. An elastic core yarn such as spandex is passed through the center of the hollow spindle. The nylon covering yarn is unwound from the rotating supply package and is wrapped around the elastic core yarn to form an elastic corespun yarn. The uninterrupted length of elastic corespun yarn formed by this apparatus is limited by the size of the covering yarn supply package which can be carried by the rotating spindle. Because the covering yarn is used at a much faster rate than the core yarn, the winding apparatus must frequently be stopped to replenish the covering yarn supply package.

It has been proposed to provide a longer run of elastic corespun yarn by providing a wrapping apparatus where the covering yarn is drawn from a stationary yarn supply package into surrounding, ballooning relationship with a package of elastic core yarn carried by a fixed spindle. The elastic core yarn is metered from the package and the covering yarn is wound in wrapping engagement with the drawn core yarn.

For example, in U.S. Pat. Nos. 2,737,773 and 4,309,867 to Clarkson and Ichikawa, respectively, the elastic core yarn is metered from a stationary supply package carried by a spindle. The elastic core yarn then is wrapped by the covering yarn. In U.S. Pat. No. 4,509,320 to Maeda, a core yarn package of elastic yarn is carried by a driven spindle while the drawn elastic core yarn is wrapped by the covering yarn. A tension device provides the proper amount of tension to the elastic core yarn during wrapping.

The aforementioned apparatus provide for the production of larger units of corespun yarn with the attendant fewer winding stops necessary for replenishing a yarn supply package of the winding yarn. These apparatus, however, mandate operation at a decreased winding speed. Operation of the apparatus at higher spindle speeds increases the centrifugal force of the covering yarn causing the covering yarn to break. Operation of this type of apparatus at high spindle speeds is also limited because of the weight of the elastic core yarn unwinding mechanism.

SUMMARY OF THE INVENTION

It is therefore an object of this invention to provide an apparatus and method for forming an elastic corespun yarn and which overcomes the aforementioned deficiencies of the prior art.

Another object of this invention is to provide an apparatus and method for forming an elastic corespun yarn wherein a nonelastic covering yarn is drawn from a supply package through the spindle and radially outwardly, upwardly and inwardly in a confined passage around and in spaced relation to a core yarn package supported by the spindle and then into wrapping engagement with the core yarn.

These and other objects and advantages of the present invention are accomplished by an apparatus and method for forming an elastic corespun yarn which is characterized by having increased winding speed and the ability to produce a larger package of corespun yarn so that a covering yarn supply package of any desired size may be utilized to produce elastic corespun yarn of a length limited only by the length of the elastic core yarn which can be supplied by the core yarn package. The covering yarn is confined in its path of travel around the core yarn package thereby preventing breakage due to centrifugal force and air resistance even at very high spindle speeds.

The apparatus includes a spindle holding frame having a spindle rotatably mounted thereon for rotation about a longitudinal axis. Drive means is operatively connected to the spindle for rotating the spindle about the axis. A core yarn package of relatively elastic yarn is carried by the spindle coaxially therewith. The core yarn package is held stationary relative to the spindle as the spindle rotates.

A guide passageway is defined in the lower portion of the spindle along the longitudinal axis thereof for a predetermined distance upwardly from the lower end of the spindle and radially outwardly to the periphery of the spindle. Yarn confinement means in the form of a cylinder having eyelets positioned therein is mounted on the spindle for rotation therewith and defines a confined yarn guide passageway from the spindle guide passageway outwardly, upwardly and inwardly around and in spaced relation to a core yarn package supported on the core yarn support means for confining and guiding the covering yarn from the longitudinal axis of the spindle outwardly, upwardly and inwardly of the core yarn package.

Means is provided for withdrawing an elastic core yarn from the core yarn package supported by the spindle and for feeding the elastic core yarn in a direction substantially along the spindle longitudinal axis thereof. Means is also included for withdrawing a nonelastic covering yarn from a supply package, through the spindle and yarn confinement means guide passageways, and into wrapping engagement with the elastic core yarn for forming an elastic corespun yarn.

BRIEF DESCRIPTION OF THE DRAWINGS

Other objects and advantages will appear as the description proceeds when taken in connection with the accompanying drawings in which.

DETAILED DESCRIPTION OF THE PREFERRED EMBODIMENT

Figure 1:
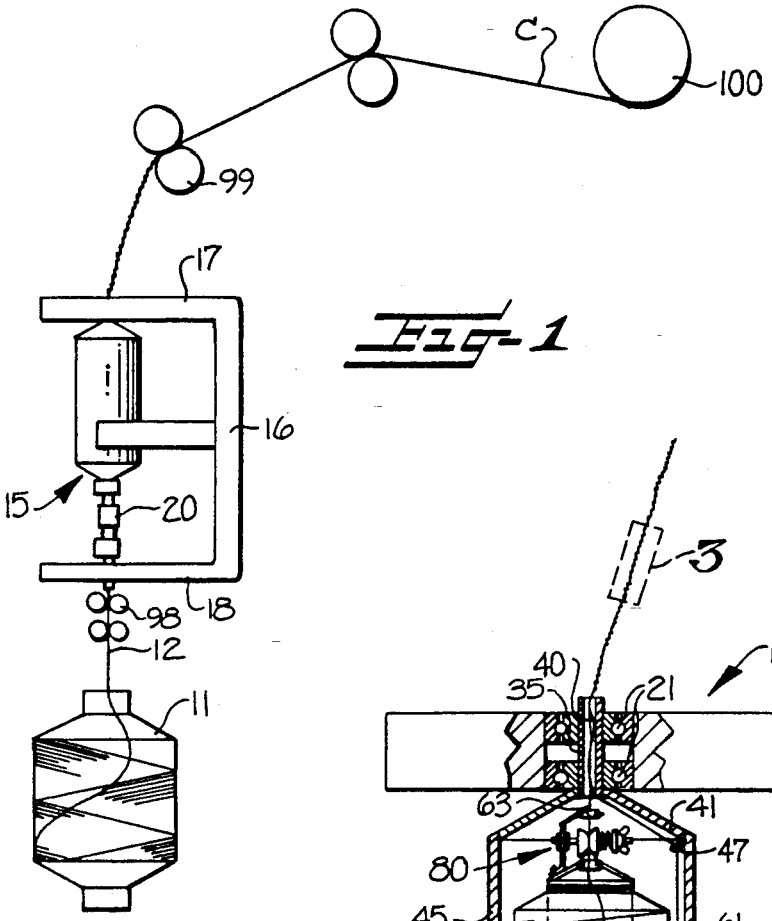
FIG. 1 is a fragmentary elevational view of the apparatus for forming a corespun yarn in accordance with the present invention.

Referring now to the drawings, FIG. 1 illustrates the apparatus of the present invention for forming an elastic corespun yarn, broadly indicated at C, wherein the apparatus is characterized by having an increased winding speed and the ability to produce a larger package of corespun yarn C. As shown in greater detail in FIG. 2, the apparatus includes a spindle assembly, broadly indicated at 15, which includes a spindle holding frame 16 with respective upper and lower cantilevered arms 17, 18. It is to be understood that a plurality of these spindle assemblies 15 are provided in side-by-side relationship in two full rows along the outside of an elastic yarn spindle wrapping machine.

A spindle, broadly indicated at 20, is rotatively mounted in the cantilevered arms 17, 18 by means of respective upper and lower bearing assemblies 21, 22 so that the spindle defines a longitudinal axis extending through both of the arms. Additional bearing assemblies 23, 24 rotatably support the lower portion of the spindle 20. The spindle 20 includes a lower spindle portion 30 mounted for rotation in the three sets of bearings 22, 23 and 24. The lower spindle portion 30 is hollow and includes a lower guide passageway 31 defining an axial passageway extending in the lower portion of the spindle, and an exit orifice or passageway 32 exiting radially from the spindle 20. An upper hollow spindle portion 35 is mounted for rotation in the upper cantilevered arm 17 by the upper bearing assembly 21 therein. The upper spindle portion 35 includes an upper guide passageway 40 extending coaxially through the top portion and exiting coaxially therefrom.

Figure 2:
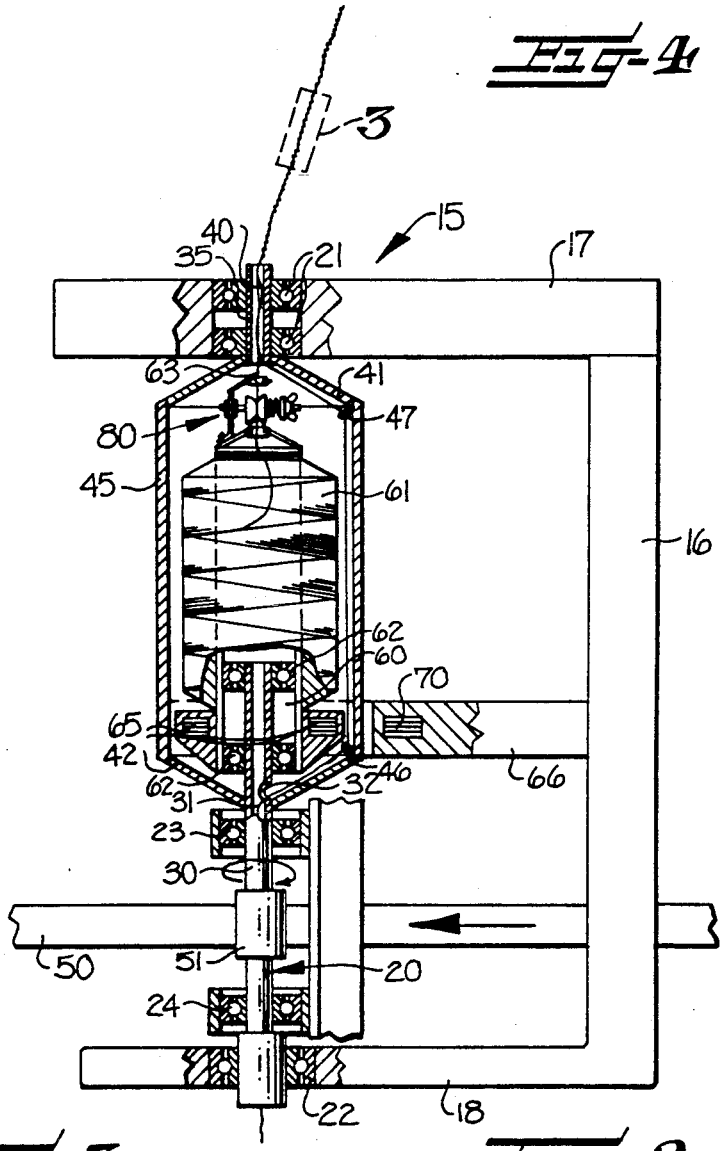
FIG. 2 is an enlarged fragmentary sectional view of the spindle in accordance with the present invention.

As illustrated in FIG. 2, the medial portion of the spindle 20 includes respective top and bottom conical caps 41, 42 and a cylinder 45 is secured to the caps 41, 42 and coaxially therebetween so that as the spindle 20 rotates, the cylinder 45 rotates therewith. The cylinder 45 is positioned so that the radially extending exit orifice 32 is positioned within the confines of the cylinder 45. A first eyelet 46 is fixed inside the cylinder 45 where the lower cap 41 and cylinder 45 connect. A second eyelet 47 is fixed above the first eyelet 46. Both eyelets 46, 47 and the cylinder 45 define a confined yarn guide passageway from the spindle guide passageway 31 and orifice 32 outwardly, upwardly and inwardly in the cylinder 45. Additionally, a tube (not shown) can extend between the exit orifice 32 and the first eyelet 46, between the eyelets 46, 47 and between eyelet 47 and the upper guide passageway 40 to facilitate threading by vacuum drawing instead of by conventional mechanical threading apparatus. Preferably, the cylinder 45 is made from a strong, lightweight material, such as titanium or a composite, lightweight material such as carbon fiber.

Drive means, in the form of an endless drive belt 50, is operatively connected to the spindle 20 for rotating the spindle 20 about the longitudinal axis. The belt 50 engages a cylindrical drive hub 51 positioned on the lower spindle portion 30. As the belt 50 moves at a high speed, it engages the lower spindle portion 30 to rotate the spindle at a very high RPM—as much as 50,000 to 60,000 RPM.

A yarn package support carrier 60 is positioned on the upper part of the lower spindle portion 30 and extends above the radially extending exit orifice 32. The support carrier 60 is inside the confines of the cylinder 45 for supporting, in substantial axial alignment with the spindle 20, a core yarn package 61 of relatively elastic yarn 63, preferably spandex. The yarn package support carrier 60 is provided with spaced upper and lower bearings 62 which receive and support the core yarn package 61 so that the elastic core yarn 63 may be withdrawn therefrom. The yarn package support carrier 60 includes a permanent magnet 65 positioned therewithin. A cantilevered support arm 66 is provided adjacent the outer perimeter of the cylinder 45 and has a free end partially surrounding the cylinder 45. A magnet 70 (FIG. 2), which can be a permanent magnet or an electromagnet, is fixed in the arm 66 and adjacent the perimeter of the cylinder 45. The magnet 70 provides an attracting magnetic force for attracting the permanent magnet 65 positioned on the yarn package support carrier 60 and for holding the yarn package support carrier 60 stationary relative to the spindle 20 as the spindle 20 rotates.

Figure 4:
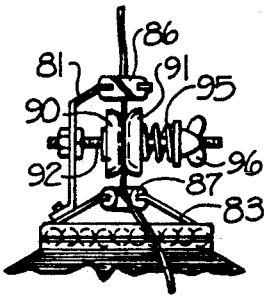
FIG. 4 is an enlarged vertical sectional view of the tension control device shown in FIG. 2.

When the core yarn package 61 is positioned on the yarn package support carrier 60, in the manner illustrated, a yarn tension applicator or control device, broadly indicated at 80, is positioned on the upper end of the spool of the core yarn package 61 to provide the required amount of tension to the core yarn 63 as it is drawn off the yarn package 61. Various types of conventional tension control, such as the illustrated disc type, can be used. As illustrated in greater detail in FIG. 4, the illustrated tension control device 80 includes a support bracket 81 fixed at its lower end on the upper portion of a thrust bearing 83 and positioned at the lower portion of the housing. The thrust bearing is dimensioned for receipt onto the spool 61*a* of the yarn package 61. The thrust bearing 83 allows the yarn tension control device 80 to rotate as needed during the wrapping operation of the covering yarn 12 onto the core yarn 63. The yarn tension control device 80 includes upper and lower grommets 86, 87 for allowing the core yarn 63 to pass therethrough with minimal friction. Positioned in the housing are a pair of discs 90, 91 engaging each other and supported by a threaded shaft 92 extending through the bracket 81. A yarn passageway 93 extends between the discs 90, 91 and the shaft 92 for allowing the core yarn 63 to pass therebetween. A spring 95 is positioned between one of the discs and a wing nut 96, and pressure may be increased or decreased against the other disc by turning the wing nut 96 positioned on the threaded shaft 92. Pressure is increased by turning the wing nut 96 inward to increase spring pressure against the discs, thus resulting in increased tension on the core yarn drawn therebetween. When the wing nut 96 is turned outward, spring pressure is decreased resulting in a decreased tension on the core yarn. If a magnetic tensioner is used, tension automatically can be adjusted. With the illustrated embodiment, an opening (not shown) can be provided in the cylinder wall for allowing an operator to manually adjust tension.

A lower set of rolls 98 are positioned beneath the spindle 20 for aiding in guiding a covering yarn 63 upwardly through the lower guide passageway 31. An upper set of rolls 99 working with a take-up roll 100 draw the formed corespun yarn C.

METHOD OF OPERATION

Initially, a covering yarn is threaded through the lower set of rolls 98 into the lower guide passageway 31, outward into the cylinder 45 and through the eyelets 46, 47. When a tube is used as described above, vacuum may be used for threading the yarn. Otherwise, a mechanical threading apparatus is used. The covering yarn 12 is drawn in wrapping engagement with the core yarn 63 and the resulting corespun yarn C is drawn upward through the upper guide passageway 40 to the upper set of draft rolls 99 where it is wound on the core of a take-up roll 100.

Figure 3:
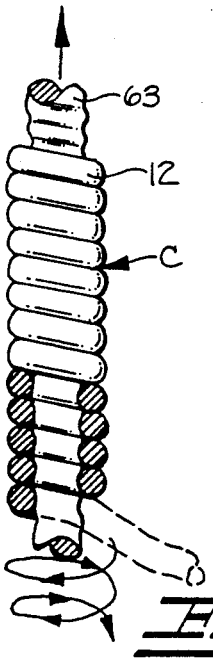
FIG. 3 is an enlarged partial sectional view of the dotted line area marked 3 in FIG. 2 and showing in detail the formed corespun yarn.

The spindle 20 is rotated at a high RPM ranging from 50,000 to 60,000 RPM. The upper set of rolls 99 pull the formed corespun yarn C upwardly while pulling the core yarn 63 and the covering yarn 12 from their respective yarn packages 61, 11. As the spindle 20 rotates, the covering yarn 12 is centrifugally forced against the inside wall of the cylinder. During high speed spindle operation, the cylinder 45 and eyelets 46, 47 guide the covering yarn 12 to a restricted diameter for preventing breakage of the covering yarn. The covering yarn rotates with the cylinder and is forced into wrapping engagement with the core yarn to form the resulting corespun yarn (FIG. 3). Additionally, the magnet 70 is energized for preventing rotation of the yarn package support carrier 60 having the core yarn package supported thereon.

The invention offers several benefits over other prior art apparatus. Because the covering yarn package is not carried by the spindle, longer runs of the apparatus can be accomplished without changing the yarn packages. Additionally, the cylinder in which the covering yarn is confined during its centrifugal, advance upward prevents breakage of the covering yarn during high speed spindle operation.

In the drawing and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A method of forming an elastic corespun yarn comprising the steps of supporting a core yarn package in an upright stationary manner on and concentric to an upright hollow spindle with the axis of the package being vertically arranged within a surrounding rotatable housing, supporting a package of relatively inelastic covering yarn at a location remote from said core yarn, withdrawing the core yarn from the core yarn package through a yarn tensioner positioned thereabove while withdrawing the covering yarn from its package and into the upright hollow spindle and laterally out of an opening in a side wall of the spindle extending within the housing and into covering relation to the withdrawn core yarn and while guiding the covering yarn through internal guides on the rotatable housing and while rotating the housing and the guides therewith at a relatively high speed to effect the desired number of wrappings on the core yarn and to obtain a high rate of production of the elastic corespun yarn.

2. A method of forming an elastic corespun yarn comprising the steps of supporting a core yarn package in an upright stationary manner on and concentric to an upright hollow spindle with the axis of the package being vertically arranged within a surrounding rotatable housing, supporting a package of relatively inelastic covering yarn at a location below said core yarn package, withdrawing the core yarn from the core yarn package through a yarn tensioner positioned thereabove while withdrawing the covering yarn from its package therebelow and upwardly into the upright hollow spindle and laterally out of an opening in a side wall of the spindle extending within the housing and into covering relation to the withdrawn core yarn and while guiding the covering yarn through internal guides on the rotatable housing and while rotating the housing and the guides therewith at a relatively high speed to effect the desired number of wrappings on the core yarn and to obtain a high rate of production of the elastic corespun yarn.

3. A method of forming an elastic corespun yarn comprising the steps of supporting a core yarn package in an upright stationary manner on and concentric to an upright hollow spindle with the axis of the package being vertically arranged within a surrounding rotatable housing, supporting a package of relatively inelastic covering yarn at a location remote from said core yarn, withdrawing the core yarn from the core yarn package through a yarn tensioner positioned thereabove while allowing free rotation of the yarn tensioner to facilitate the withdrawal of the yarn and while withdrawing the covering yarn from its package and into the upright hollow spindle and laterally out of an opening in a side wall of the spindle extending within the housing and into covering relation to the withdrawn core yarn and while guiding the covering yarn through internal guides on the rotatable housing and while rotating the housing and the guides therewith at a relatively high speed to effect the desired number of wrappings on the core yarn and to obtain a high rate of production of the elastic corespun yarn.

4. A method for forming an elastic corespun yarn comprising the steps of supporting a core yarn package of relatively elastic core yarn for rotation about a longitudinal axis on core yarn package support means rotatably mounted on an upright rotatable hollow spindle mounted in vertical orientation on a spindle holding frame within an upright rotatable housing, rotating the hollow spindle while maintaining the package of relatively elastic core yarn stationary relative to the rotating spindle, withdrawing the core yarn from the package through a yarn tension applicator rotatably mounted on the top portion of the core yarn package so that the core yarn is withdrawn circumferentially from around the package under tension without binding during withdrawal of the yarn, supporting a package of relatively inelastic covering yarn at a location remote from the rotating hollow spindle, while contemporaneously withdrawing the covering yarn from the package and delivering a running length thereof into the lower end of the rotating hollow spindle, and guiding the covering yarn initially along the longitudinal axis of the rotating hollow spindle and then radially outwardly thereof through a lateral opening in a side wall of the spindle within the housing to beyond the core yarn package, and guiding the yarn upwardly along the interior surface of the housing and in spaced relation to the core yarn package and then radially inward to a location above the core yarn package to the longitudinal axis of the spindle above the core yarn package and into wrapping engagement to the core yarn withdrawn through the tension applicator.

5. An apparatus for forming an elastic corespun yarn which is characterized by having increased winding speed and the ability to produce a large package of corespun yarn, said apparatus comprising a rotatable hollow spindle, core yarn package support means rotatably mounted on said hollow spindle for supporting a core yarn package in an upright position, holding means cooperating with said core yarn package support means for preventing rotation thereof so that the core yarn package is held stationary, a rotatable housing surrounding said core yarn package support means, said housing having internal yarn guides, means for feeding an inelastic covering yarn to said hollow spindle, means for directing the covering yarn from said hollow spindle to said internal yarn guides on said rotatable housing, said means including an opening in a side wall of said hollow spindle, said opening extending within said housing, and mean for rotating the housing and yarn guides therewith at a relatively high speed to effect the desired number of wrappings on the core yarn and to obtain a high rate of production of an elastic corespun yarn.

6. An apparatus for forming an elastic corespun yarn, said apparatus comprising, a spindle holding frame, a spindle rotatably mounted in vertical orientation on said frame for rotation about a longitudinal axis, drive means operatively connected to said spindle for rotating said spindle about said axis, means rotatably mounted on said spindle for supporting a core yarn package of relatively elastic yarn in vertical axial alignment therewith, means for holding said rotatably mounted core yarn package support means stationary relative to said spindle as said spindle rotates, a core yarn package of relatively elastic yarn mounted on said support means, said core yarn package comprising a longitudinally extending cylindrical spool oriented vertically so that the longitudinal axis defined by the core yarn package is oriented in axial alignment with the longitudinal axis defined by the spindle, confinement means supported by said spindle and rotatable therewith, and enclosing said core yarn support mans and said core yarn package supported on said support means, and wherein said confinement mean sis a cylindrical member and aligned longitudinally along said vertically oriented axis, a yarn tension applicator mounted on the top portion of the core yarn package and within the cylindrical member for receiving core yarn after withdrawal from said core yarn package and applying tension to the core yarn, and wherein the yarn tension applicator includes means for allowing free rotation of the yarn tension applicator relative to the core yarn package to facilitate withdrawal of the relatively elastic core yarn from the package as the core yarn is withdrawn circumferentially from around the package without having binding of the yarn as it is withdrawn, means defining a yarn guide passageway in the lower portion of said spindle along the longitudinal axis thereof for a predetermined distance upwardly from the lower end of said spindle and radially outwardly to the periphery of said spindle into said cylindrical member, and means carried by said cylindrical member in the interior thereof for guiding the yarn from said first yarn guide passageway portion along the interior of the cylindrical member and in spaced relation to said core yarn package to a location above the core yarn package, means for withdrawing an elastic core yarn from said core yarn package and for feeding the elastic core yarn through said yarn tension applicator and in a direction substantially along the spindle longitudinal axis thereof, and means for withdrawing a nonelastic covering yarn from a supply package through said spindle and along said guide means of said cylindrical member into wrapping engagement with said elastic core yarn for forming an elastic corespun yarn, whereby a covering yarn supply package of any desired size is utilized to produce elastic corespun yarn of a length limited only by the length of elastic core yarn which is supplied by the core yarn package, and whereby the covering yarn is confined in its path of travel around the core yarn package thereby preventing breakage due to centrifugal force and air resistance even at very high spindle speeds.

* * * * *